US006427931B1

(12) United States Patent
Guo

(10) Patent No.: US 6,427,931 B1
(45) Date of Patent: Aug. 6, 2002

(54) SPRAYER GUN HAVING HAND GRIP POSITIONING DEVICE

(76) Inventor: Wen Li Guo, No. 10, Fang Dong Road, Wen Gin Tsuen, Fang Yuan Hsiang, Chang Hua Hsien (TW), 528

( * ) Notice: Subject to any disclaimer, the term of this patent is extended or adjusted under 35 U.S.C. 154(b) by 0 days.

(21) Appl. No.: 09/930,406

(22) Filed: Aug. 16, 2001

(51) Int. Cl.[7] ..... B05B 7/02

(52) U.S. Cl. ..... 239/526; 239/583

(58) Field of Search ..... 239/525, 526, 239/583, 451, 456

(56) References Cited

U.S. PATENT DOCUMENTS 5,232,162 A 8/1993 Chih ..... 239/394
5,630,548 A 5/1997 Chih ..... 239/394

*Primary Examiner*—Lisa A. Douglas
(74) *Attorney, Agent, or Firm*—Charles E. Baxley

(57) ABSTRACT

A sprayer gun includes a handle and a valve stem slidably received in the rear portion. A stop is secured to the valve stem and engaged with the handle, and has one or more ratchet teeth. A spring lever has one end secured to the handle and has a number of ratchet teeth for engaging with the ratchet teeth of the stop and for preventing the stop from being moved forward relative to the spring lever. The water is thus allowed to continuously flow out of the sprayer gun without continuously depressing the control hand grip toward the handle by the the ratchet teeth.

6 Claims, 5 Drawing Sheets

SPRAYER GUN HAVING HAND GRIP POSITIONING DEVICE

BACKGROUND OF THE INVENTION

1. Field of the Invention

The present invention relates to a sprayer gun, and more particularly to a sprayer gun having a control hand grip positioning device.

2. Description of the Prior Art

Various kinds of typical sprayer guns have been developed and widely used today. U.S. Pat. No. 5,232,162 to Chih, and U.S. Pat. No. 5,630,548 to Chih disclose two of the typical sprayer guns and include a control hand grip pivotally or rotatably secured to a handle and coupled to a spring-biased piston rod or valve stem, for pulling the spring-biased piston rod or valve stem rearward and outward of the sprayer gun body,and for controlling the water to flow out of the gun body. However, the control hand grip has to be continuously depressed toward the handle for allowing the water to continuously flow out of the sprayer gun. When or once the control hand grip is released or is not continuously depressed toward the handle, the spring member may bias and force the piston rod or valve stem forward and inward of the sprayer gun body in order to block the water. Accordingly, the users may have to continuously depress the control hand grip toward the handle for a long time, in order to control and to allow the water to continuously flow out of the sprayer gun.

The present invention has arisen to mitigate and/or obviate the afore-described disadvantages of the conventional sprayer guns.

SUMMARY OF THE INVENTION

The primary objective of the present invention is to provide a sprayer gun including a control hand grip positioning device for positioning the control hand grip to a handle of the sprayer gun and for allowing the water to continuously flow out of the sprayer gun without continuously depressing the control hand grip toward the handle.

In accordance with one aspect of the invention, there is provided a sprayer gun comprising a sprayer gun body including a handle extended therefrom, and including a rear portion having a valve stem slidably received therein and extendible rearward and outward therefrom, the valve stem including a rear end, a stop secured to the rear end of the valve stem, and including at least one first ratchet tooth extended therefrom, a handle including a middle portion pivotally secured to the handle, and including an upper portion having an opening formed therein for slidably receiving the valve stem, the upper portion of the handle being engaged with the stop for moving the valve stem rearward and outward of the sprayer gun body, and a spring lever including a first end secured to the handle and including a plurality of second ratchet teeth provided thereon for engaging with the first ratchet tooth of the stop and for allowing the stop to be moved rearward relative to the spring lever and for preventing the stop from being moved forward relative to the spring lever. The water is thus allowed to continuously flow out of the sprayer gun without continuously depressing the control hand grip toward the handle by the engagement between the ratchet teeth of the stop and the spring lever. The stop is allowed to be moved forward relative to the spring lever when the second ratchet teeth are disengaged from the first ratchet tooth of the stop.

The handle includes a seat extended from the rear portion thereof, the first end of the spring lever is engaged with the seat for preventing the spring lever from being rotated relative to the handle.

One or more fasteners may further be provided for securing the first end of the spring lever to the handle.

A device may further be provided for retaining an engagement of the second ratchet teeth of the spring lever with the first ratchet tooth of the stop, and includes a guide extended from the stop and engaged with the spring lever, for retaining the second ratchet teeth of the spring lever in engagement with the first ratchet tooth of the stop.

The spring lever includes a knob for being depressed to disengage the second ratchet teeth of the spring lever from the first ratchet tooth of the stop.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
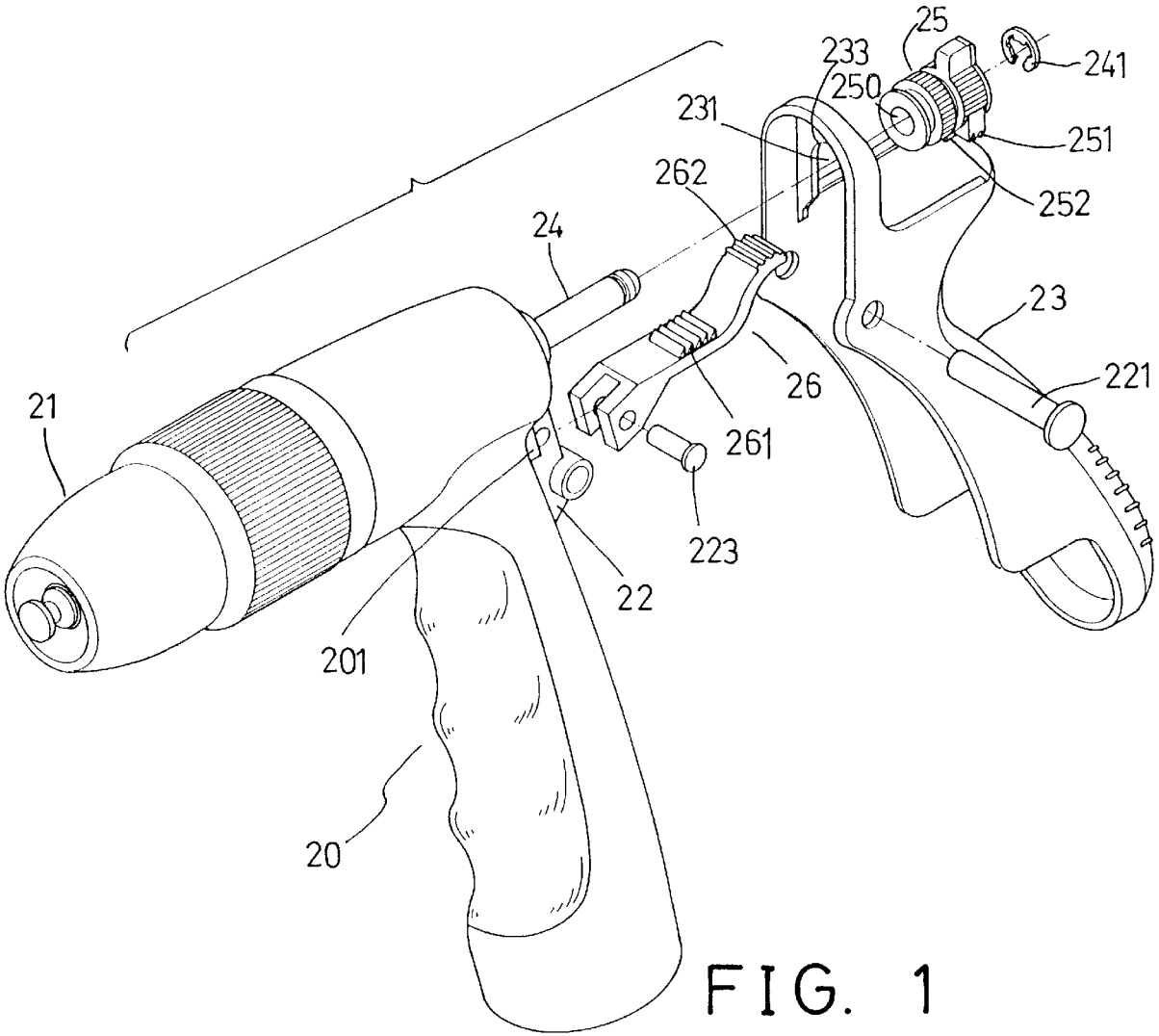
FIG. 1 is a partial exploded view of a sprayer gun in accordance with the present invention.
Figure 2:
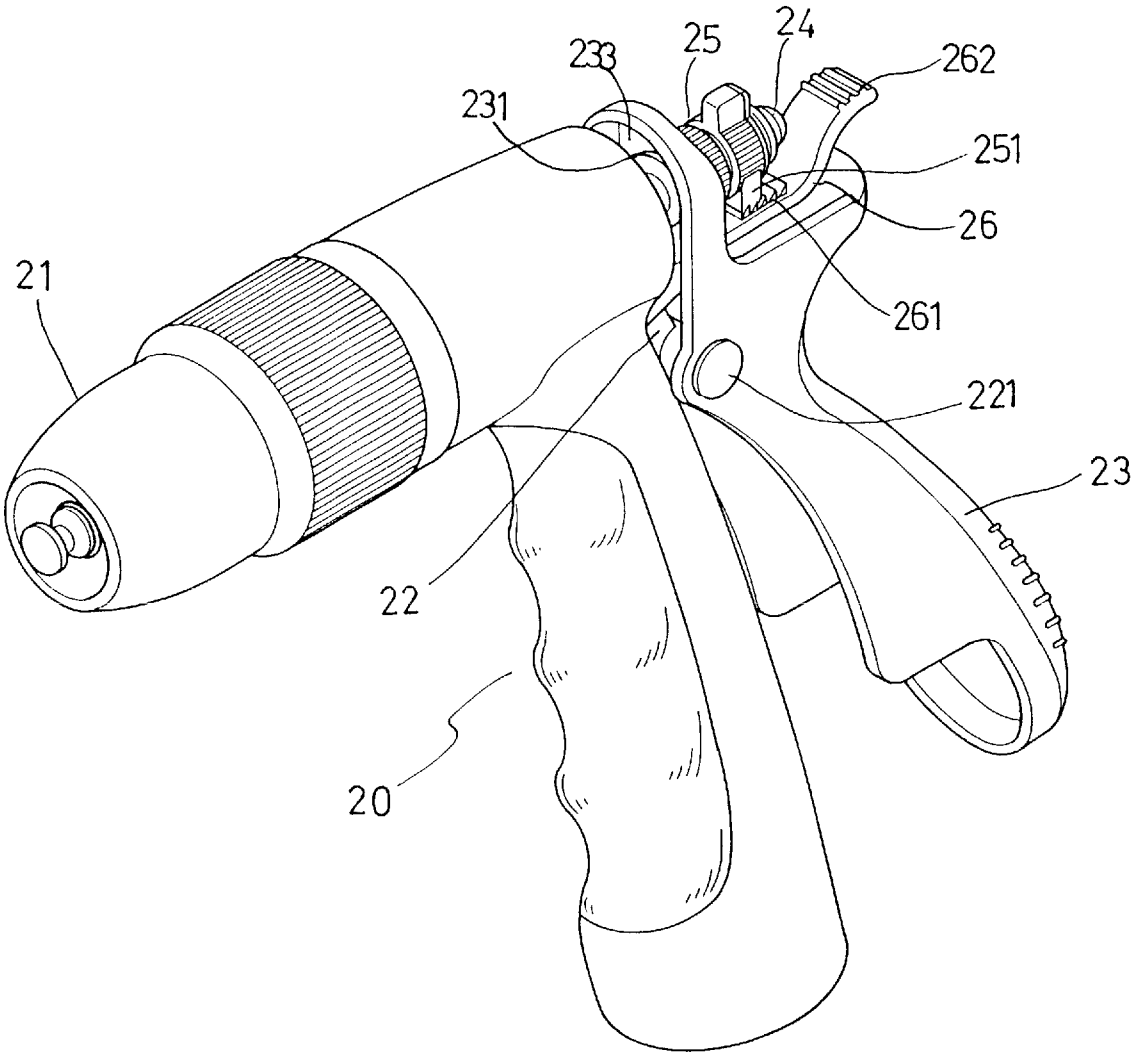
FIG. 2 is a perspective view of the sprayer gun.
Figure 3:
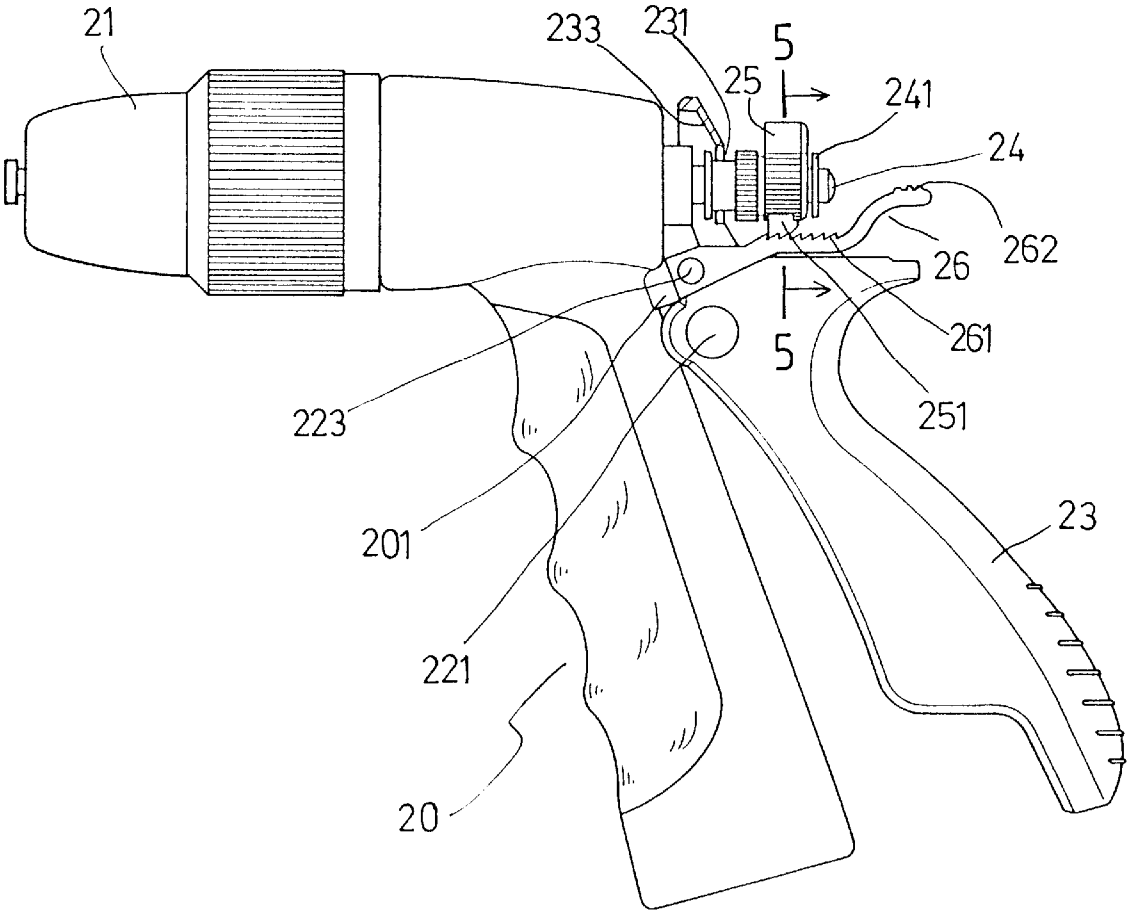
FIG. 3 is a plan view of the sprayer gun.

Referring to the drawings, and initially to FIGS. 1–3, a sprayer gun in accordance with the present invention comprises a handle 20 extended downward from the gun body 21, particularly extended downward from the rear portion of the gun body 21. The handle 20 includes an ear 22 extended rearward therefrom, such as extended rearward from the upper portion thereof. A control hand grip 23 includes a middle portion pivotally or rotatably secured to the handle 20, such as secured to the ear 22 of the handle 20 with a pivot shaft 221, for allowing the hand grip 23 to be moved toward and away from the handle 20 about the pivot shaft 221. The hand grip 23 includes an upper portion having an opening 231 formed therein and formed or defined by a peripheral wall 233. A spring-biased piston rod or a valve stem 24 is slidably received in the gun body 21 and includes a rear portion extended rearward and outward of the gun body 21.

A stop, such as a ring-shaped stop 25 is engaged on the valve stem 24. A clamping ring 241 of the like is engaged onto the rear end of the valve stem 24 and engaged with the stop 25, such that the stop 25 may be positioned or retained between the peripheral wall 233 of the hand grip. 23 and the clamping ring 241 of the valve stem 24, and such that the valve stem 24 may be pulled outward against the spring members (not shown) provided in the gun body 21 by depressing the hand grip 23 toward the handle 20. The above-described sprayer gun configuration is typical and has been disclosed at least in U.S. Pat. No. 5,232,162 to Chih, and U.S. Pat. No. 5,630,548 to Chih, which are taken as a reference for the present invention.

The sprayer gun in accordance with the present invention further comprises a spring lever 26 including one end, such as the front end secured to the handle 20, such as secured to the ear 22 of the handle 20 with a fastener 223. The handle 20 includes a seat 201 extended rearward therefrom, such as extended rearward from the upper portion thereof, and located close to the ear 22 thereof. The front end of the spring lever 26 is engaged with the seat 201 for positioning the spring lever 26 to the handle 20 and for preventing the spring lever 26 from being rotated relative to the handle 20. The spring lever 26 includes one or more ratchet teeth 261 formed or provided on the middle portion thereof, and includes a knob 262 formed or provided on the rear end or the free end thereof.

Figure 4:
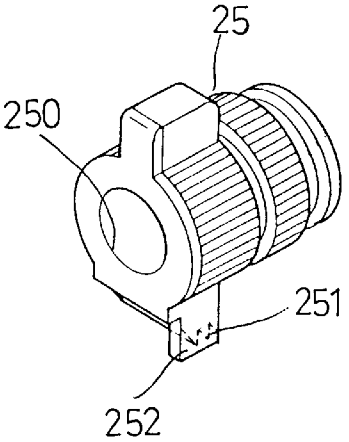
FIG. 4 is a perspective view illustrating a control device of the sprayer gun.
Figure 5:
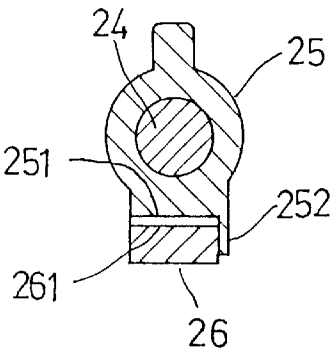
FIG. 5 is a partial cross sectional view taken along lines 5—5 of FIG. 3.

The stop 25 includes one or more teeth 251 provided or extended on the bottom portion thereof for engaging with the ratchet teeth 261 of the spring lever 26, and for allowing the stop 25 to be moved rearward relative to the spring lever 26 (FIGS. 6, 7), and for preventing the stop 25 from moving forward relative to the spring lever 26. As best shown in FIGS. 4 and 5, the stop 25 further includes a guide 252 extended downward therefrom, particularly extended downward from one side thereof, for engaging with the spring lever 26, best shown in FIG. 5, and for positioning the stop 25 relative to the spring lever 26, and for allowing the ratchet teeth 251, 261 of the stop 25 and the spring lever 26 to be effectively engaged with each other, and for preventing the ratchet teeth 251, 261 of the stop 25 and the spring lever 26 from being disengaged from each other.

Figure 7:
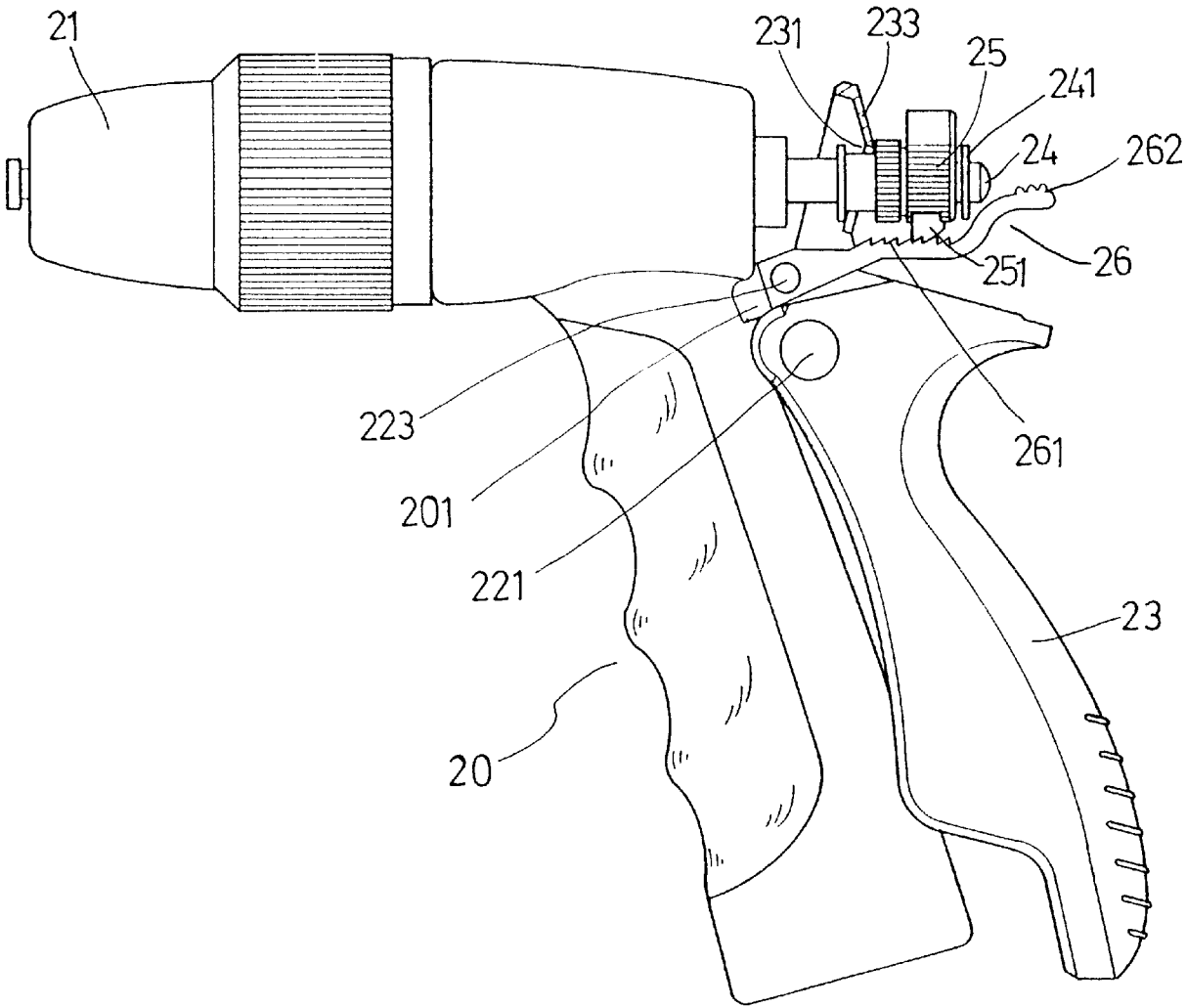

In operation, as shown in FIG. 7, when the hand grip 23 is moved or rotated toward the handle 20, the valve stem 24 may be moved rearward by the hand grip 23, and the ratchet teeth 251 of the stop 25 may be moved rearward relative to that of the spring lever 26. The engagement between the ratchet teeth 251, 261 of the stop 25 and the spring lever 26 allows the stop 25 to be moved rearward relative to the spring lever 26 (FIG. 7) and may prevent the stop 25 from moving forward relative to the spring lever 26. The hand grip 23 may thus be retained or positioned to the handle 20 by the engagement between the ratchet teeth 251, 261 of the stop 25 and the spring lever 26, when the hand grip 23 is released.

Figure 6:
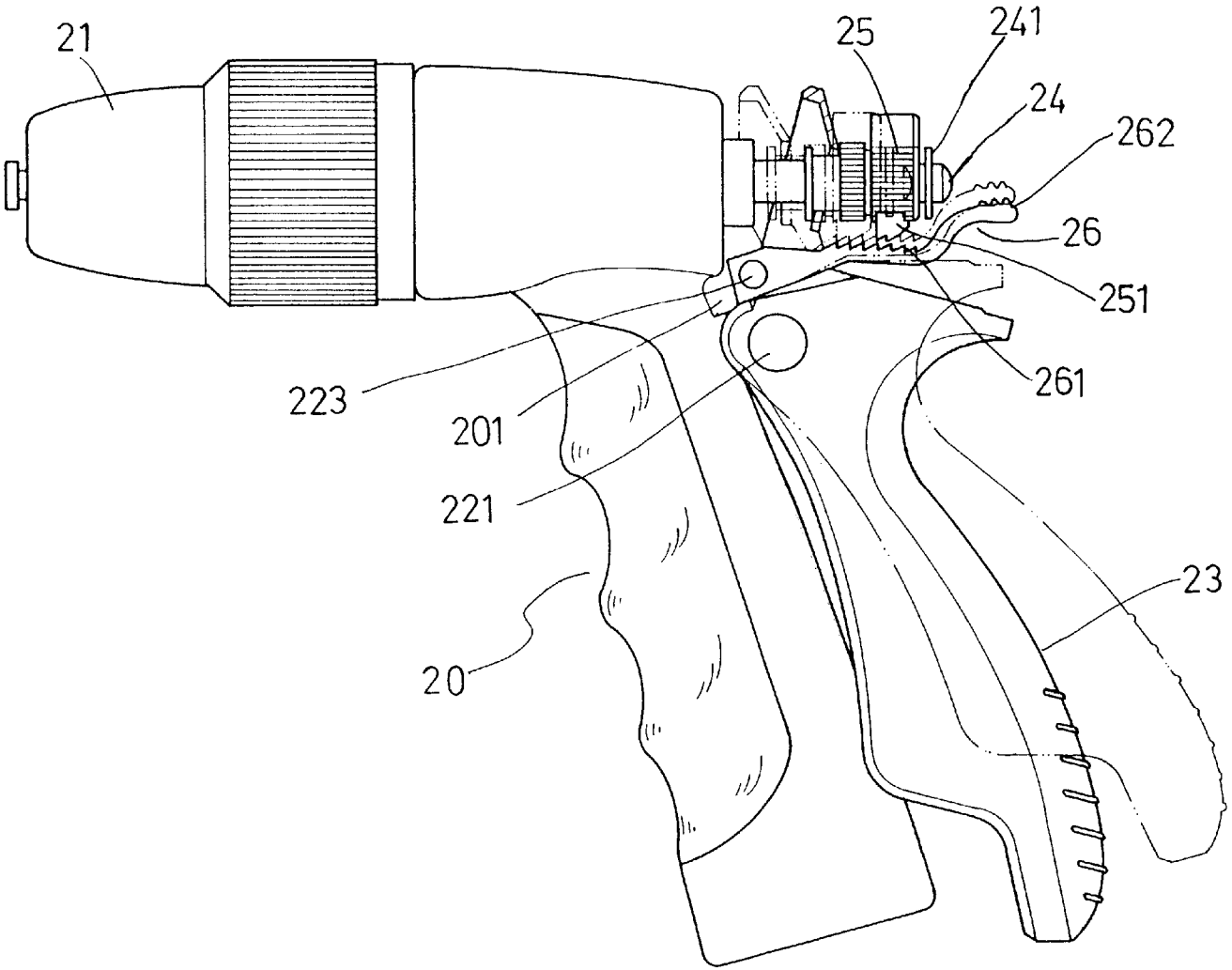
FIGS. 6 and 7 are plan views similar to FIG. 3, illustrating the operation of the sprayer gun.

As shown in, FIG. 6, when the knob 262 of the spring lever 26 is depressed, the ratchet teeth 251 of the stop 25 may be disengaged from the ratchet teeth 261 of the spring lever 26, such that the stop 25 may be moved freely of forward and rearward relative to the spring lever 26. Actually, when the ratchet teeth 251 of the stop 25 are disengaged from the ratchet teeth 261 of the spring lever 26, the stop 25 may be moved forward relative to the spring lever 26 by the spring-biased valve stem 24.

Accordingly, the sprayer gun in accordance with the present invention includes a control hand grip positioning device for positioning the control hand grip to a handle of the sprayer gun and for allowing the water to continuously flow out of the sprayer gun without continuously depressing the control hand grip toward the handle.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A sprayer gun comprising:

a sprayer gun body including a handle extended therefrom, and including a rear portion having a valve stem slidably received therein and extendible rearward and outward therefrom, said valve stem including a rear end, a stop secured to said rear end of said valve stem, and including at least one first ratchet tooth extended therefrom, a handle including a middle portion pivotally secured to said handle, and including an upper portion having an opening formed therein for slidably receiving said valve stem, said upper portion of said handle being engaged with said stop for moving said valve stem rearward and outward of said sprayer gun body, and a spring lever including a first end secured to said handle and including a plurality of second ratchet teeth provided thereon for engaging with said at least one first ratchet tooth of said stop and for allowing said stop to be moved rearward relative to said spring lever and for preventing said stop from being moved forward relative to said spring lever, said stop being allowed to be moved forward relative to said spring lever when said second ratchet teeth are disengaged from said at least one first ratchet tooth of said stop.

2. The sprayer gun according to claim 1, wherein said handle includes a seat extended from said rear portion thereof, said first end of said spring lever is engaged with said seat for preventing said spring lever from being rotated relative to said handle.

3. The sprayer gun according to claim 2 further comprising at least one fastener for securing said first end of said spring lever to said handle.

4. The sprayer gun according to claim 2 further comprising means for retaining an engagement of said second ratchet teeth of said spring lever with said at least one first ratchet tooth of said stop.

5. The sprayer gun according to claim 4, wherein said retaining means includes a guide extended from said stop and engaged with said spring lever, for retaining said second ratchet teeth of said spring lever in engagement with said at least one first ratchet tooth of said stop.

6. The sprayer gun according to claim 1, wherein said spring lever includes a knob for being depressed to disengage said second ratchet teeth of said spring lever from said at least one first ratchet tooth of said stop.

* * * * *